US009668329B2

(12) United States Patent
Chen et al.

(10) Patent No.: US 9,668,329 B2
(45) Date of Patent: May 30, 2017

(54) METHOD FOR OPERATING AN ELECTRONIC DEVICE TO INCREASE LIGHT DENSITY AND ELECTRONIC DEVICE THEREOF

(71) Applicant: QISDA CORPORATION, Taoyuan (TW)

(72) Inventors: Chi-Jen Chen, Taoyuan (TW); Fang-Chieh Lu, New Taipei (TW); Chuan-Chu Chen, Taoyuan (TW); Ching-Ying Tsou, Taoyuan (TW)

(73) Assignee: Qisda Corporation, Taoyuan County (TW)

( * ) Notice: Subject to any disclaimer, the term of this patent is extended or adjusted under 35 U.S.C. 154(b) by 0 days.

(21) Appl. No.: 14/846,837

(22) Filed: Sep. 7, 2015

(65) Prior Publication Data

US 2017/0071051 A1 Mar. 9, 2017

(51) Int. Cl.
*H05B 33/08* (2006.01)
*H05B 37/02* (2006.01)

(52) U.S. Cl.
CPC ..... *H05B 37/0281* (2013.01)

(58) Field of Classification Search
None
See application file for complete search history.

(56) References Cited

U.S. PATENT DOCUMENTS

2015/0085528 A1* 3/2015 Myers ..... F21S 8/04 362/612

* cited by examiner

*Primary Examiner* — Dedei K Hammond

(57) ABSTRACT

An electronic device includes a first light module, a second light module, a primary driver, and a first secondary driver. The first light module is used to emit a first light, and the second light module is used to emit a second light. The primary driver has a first control terminal for turning on the first light module during a first duration, and a second control terminal for turning on the second light module during a second duration. The first secondary driver is used to turn on the first light module during the second duration.

20 Claims, 9 Drawing Sheets

METHOD FOR OPERATING AN ELECTRONIC DEVICE TO INCREASE LIGHT DENSITY AND ELECTRONIC DEVICE THEREOF

BACKGROUND OF THE INVENTION

1. Field of the Invention

This invention relates to an electronic device that is able to emit lights, and more particularly, an electronic device that is able to emit lights with high light density.

2. Description of the Prior Art

To provide light sources to a display system, such as a projector, an electronic device for emitting lights of different colors is usually used. The electronic device may control the lights of different colors by a central control circuit for saving circuit area. FIG. 1 shows an electronic device 100 according to prior art. The electronic device 100 includes a primary driver 120, switches SW1, SW2 and SW3, and light modules 110A, 110B, and 110C. The primary driver 120 has control terminals 120$C_A$, 120$C_B$, and 120$C_C$ for controlling the switches SW1, SW2 and SW3 respectively so as to control the light modules 110A, 110B, and 110C.

Due to different turn-on conditions of the light modules 110A, 110B, and 110C, the primary driver 120 can only turn on one light module at a time. Therefore, when turning on the light module 110A, the control terminal 120$C_A$ can turn on the switch SW1 while the control terminals 120$C_B$ and 120$C_C$ can turn off the switches SW2 and SW3. In this case, the current A1 outputted from an output terminal 120$_{OUT}$ of the primary driver 120 can flow only to the light module 110A and return to a ground terminal 120$_{GND}$ of the primary driver 120. Thus, the light modules 110B and 110C will not be turned on when the light module 110A is turned on. The similar operation principles can also be applied when turning on the light module 110B or 110C.

To control lights with different colors by the same central control circuit, the central control circuit can turn on lights of different colors sequentially. Lights of different colors can be mixed by persistence of vision to produce a desirable color.

In addition, to display high quality images, there are some more factors to be considered. For example, light density is a critical factor for a display system or a lighting system, especially for a projector operated under a rather bright environment. The image displayed by the projector can be significantly affected by ambient light if the light density of the projector is not strong enough comparing to the ambient light. Since lights of different colors are turned on and turned off in different durations by the electronic device, the light density of the lights is limited by the turn-on durations of the lights, which may decrease the image quality displayed by a display system using the electronic device. Consequently, improving the light density has become an issue to be solved.

SUMMARY OF THE INVENTION

One embodiment of the present invention discloses an electronic device. The electronic device includes a first light module, a second light module, a primary driver, and a secondary driver. The first light module is used to emit a first light. The second light module is used to emit a second light. The primary driver has a first control terminal for turning on the first light module during a first duration, and a second control terminal for turning on the second light module during a second duration. The first secondary driver is used to turn on the first light module during the second duration.

Another embodiment of the present invention discloses a method for operating an electronic device. The electronic device includes a first light module, a second light module, a primary driver, and a secondary driver. The method includes the primary driver turning on the first light module to emit a first light during a first duration, the primary driver turning on the second light module to emit a second light during a second duration, and the first secondary driver turning on the first light module to emit the first light during the second duration.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
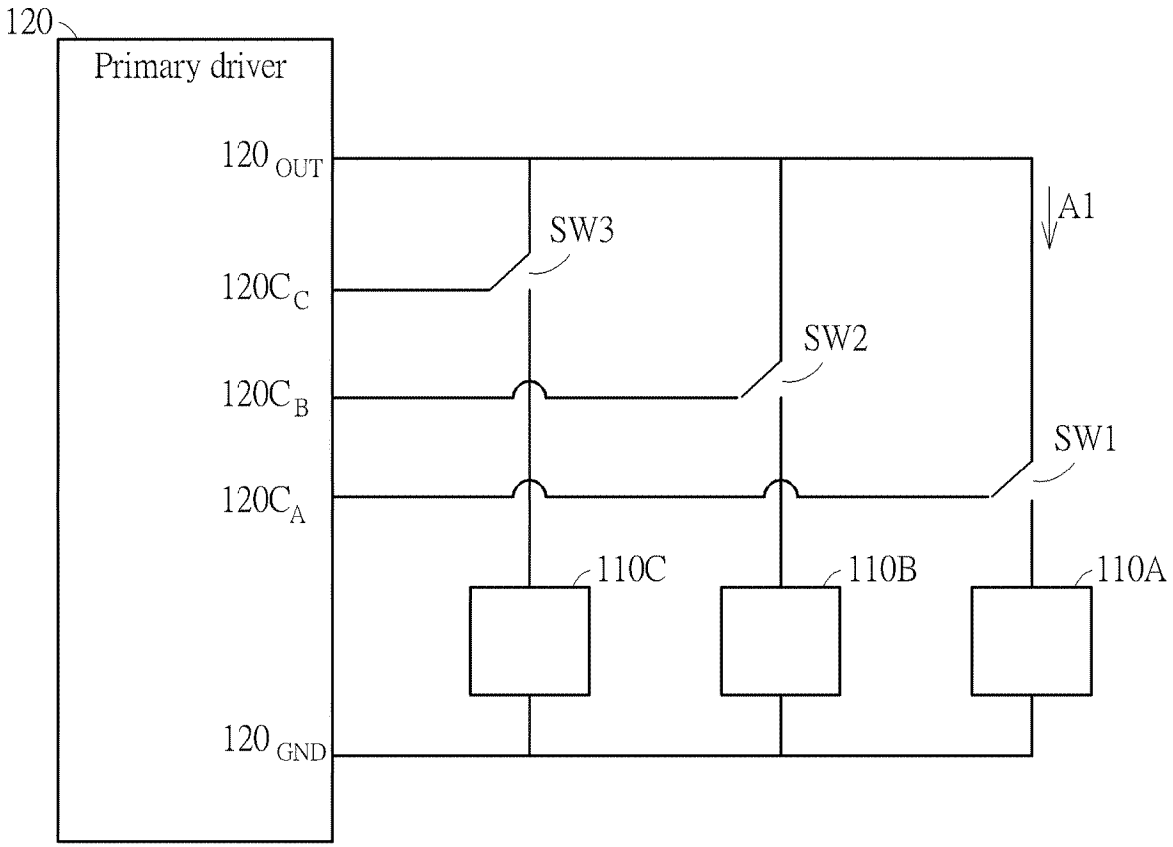
FIG. 1 PRIOR ART
FIG. 1 shows an electronic device according prior art.
Figure 2:
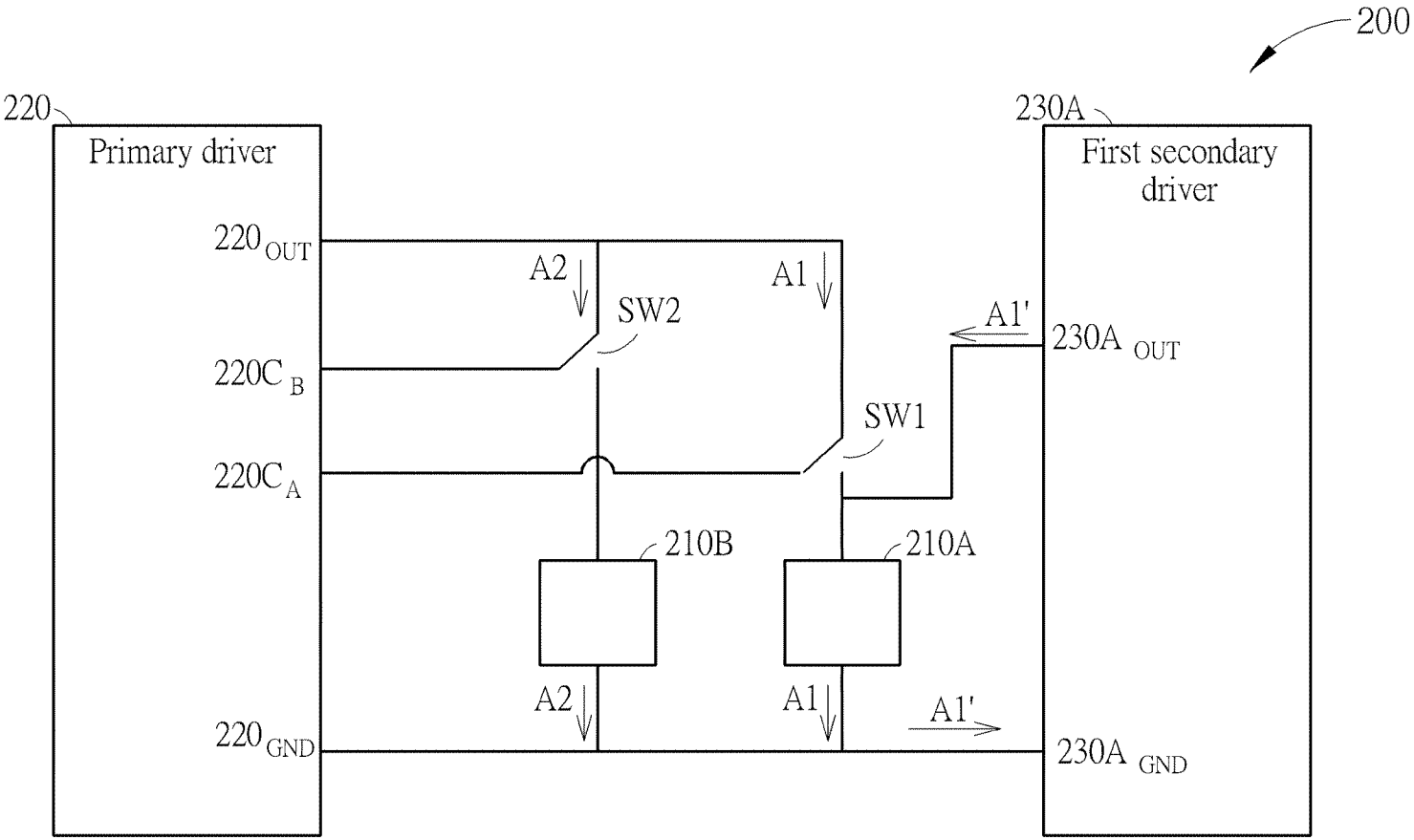
FIG. 2 shows an electronic device according to one embodiment of the present invention.

FIG. 2 shows an electronic device 200 according to one embodiment of the present invention. The electronic device includes a first light module 210A, a second light module 210B, a primary driver 220, and a first secondary driver 230A.

In some embodiments of the present invention, the first light module 210A may include a light emitting diode for emitting a first light and the second light module 210B may also include a light emitting diode for emitting a second light. The primary driver 220 has an output terminal 220$_{OUT}$ for outputting currents to the first light module 210A or the second light module 210B. To control the turn-on timing, the primary driver 220 has a first control terminal 220$C_A$ for turning on the first light module 210A and a second control terminal 220$C_B$ for turning on the second light module 210B.

In FIG. 2, when the output terminal 220$_{OUT}$ is at a first operational high voltage level and the first control terminal 220$C_A$ is at a high voltage level, a switch SW1 coupled between output terminal 220$_{OUT}$ and the first light module 210A is turned on, and a current A1 is inputted to the first light module 210A to turn on the first light module 210A. The current A1 flows from the output terminal 220$_{OUT}$ to the first light module 210A and returns to the ground terminal $\mathbf{220}_{GND}$ of the primary driver 220 for stabilizing the current A1.

Also, when the output terminal $\mathbf{220}_{OUT}$ is at a second operational high voltage level and a voltage of the second control terminal $\mathbf{220}C_B$ is at the high voltage level, a switch SW2 coupled between output terminal $\mathbf{220}_{OUT}$ and the second light module 210B is turned on, and a current A2 is inputted to the second light module 210B to turn on the second light module 210B. The current A2 flows from the output terminal $\mathbf{220}_{OUT}$ to the second light module 210B and returns to the ground terminal $\mathbf{220}_{GND}$ of the primary driver 220 for stabilizing the current A2.

Similarly, the first secondary driver 230A can turn on the first light module 210A by inputting a current A1' from an output terminal $\mathbf{230}A_{OUT}$ of the first secondary driver 230A through the first light module 210A to a ground terminal $\mathbf{230}A_{GND}$ of the first secondary driver 230A.

In addition, when the current A1 (or A2) inputted to the first light module 210A (or the second light module 210B) increases, a light density of the first light (or second light) also increases.

Figure 3:
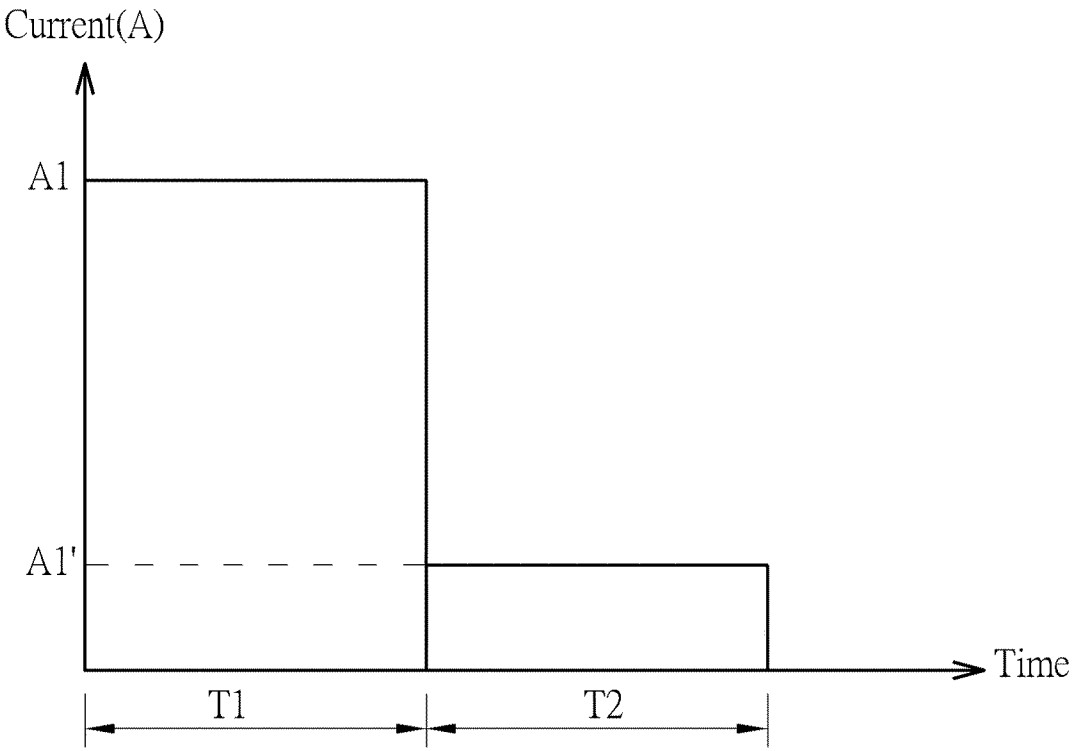
FIG. 3 shows a timing diagram of currents in the electronic device of FIG. 1.

FIG. 3 shows a timing diagram of the currents A1 and A1' inputted to the first light module 210A by the primary driver 220 and the first secondary driver 230A. In FIG. 3, during the first duration T1, the primary driver 220 turns on the first light module 210A by inputting the current A1 to the first light module 210A. In some embodiments of the present invention, during the first duration T1, the first driver 230A does not input any current to the first light module 210A. In this case, the light density of the first light emitted by the first light module 210A during the first duration T1 is controlled by the primary driver 220.

During the second duration T2, the primary driver 220 may turn on the second light module 210B by inputting the current A2 to the second light module 210B. Due to different turn-on conditions of the light modules 210A and 210B, the primary driver 220 may only turn on one light module at a time. That is, the primary driver 220 may not be able to turn on the first light module 210A during the second duration T2 while turning on the second light module 210B. Instead, the first secondary driver 230A turns on the first light module 210A during the second duration T2 by inputting the current A1' to the first light module 210A. Consequently, both the first light module 210A and the second light module 210B emit lights during the second duration T2 and the light density of the electronic device 200 can be increased.

Furthermore, to form images of different colors, the first light and the second light emitted by the first light module 210A and the second light module 210B may be lights of different colors. By adjusting intensities of the currents A1 and A2 inputted to the first light module 210A and the second light module 210B, the first light and the second light can be mixed by persistence of vision to produce different combinations of colors. That is, the primary driver 220 may control the currents A1 and A2 inputted to the first light module 210A and the second light module 210B to generate a desirable color.

To avoid the first light emitted in the second duration T2 by the first light module 210A turned on by the first secondary driver 230A from impacting the final color seen by the viewers, the current A1' inputted to the first light module 210A during the second duration T2 may be smaller than the current A1 inputted to the first light module 210A during the first duration T1 as shown in FIG. 3. That is, if the first light has a first light density when the primary driver 220 turns on the first light module 210A, and the first light has a second light density when the first secondary driver 230A turns on the first light module 210A, then the first light density will be higher than the second light density. Consequently, the light density of the electronic device 200 is increased without affecting the color seen by viewers.

Figure 4:
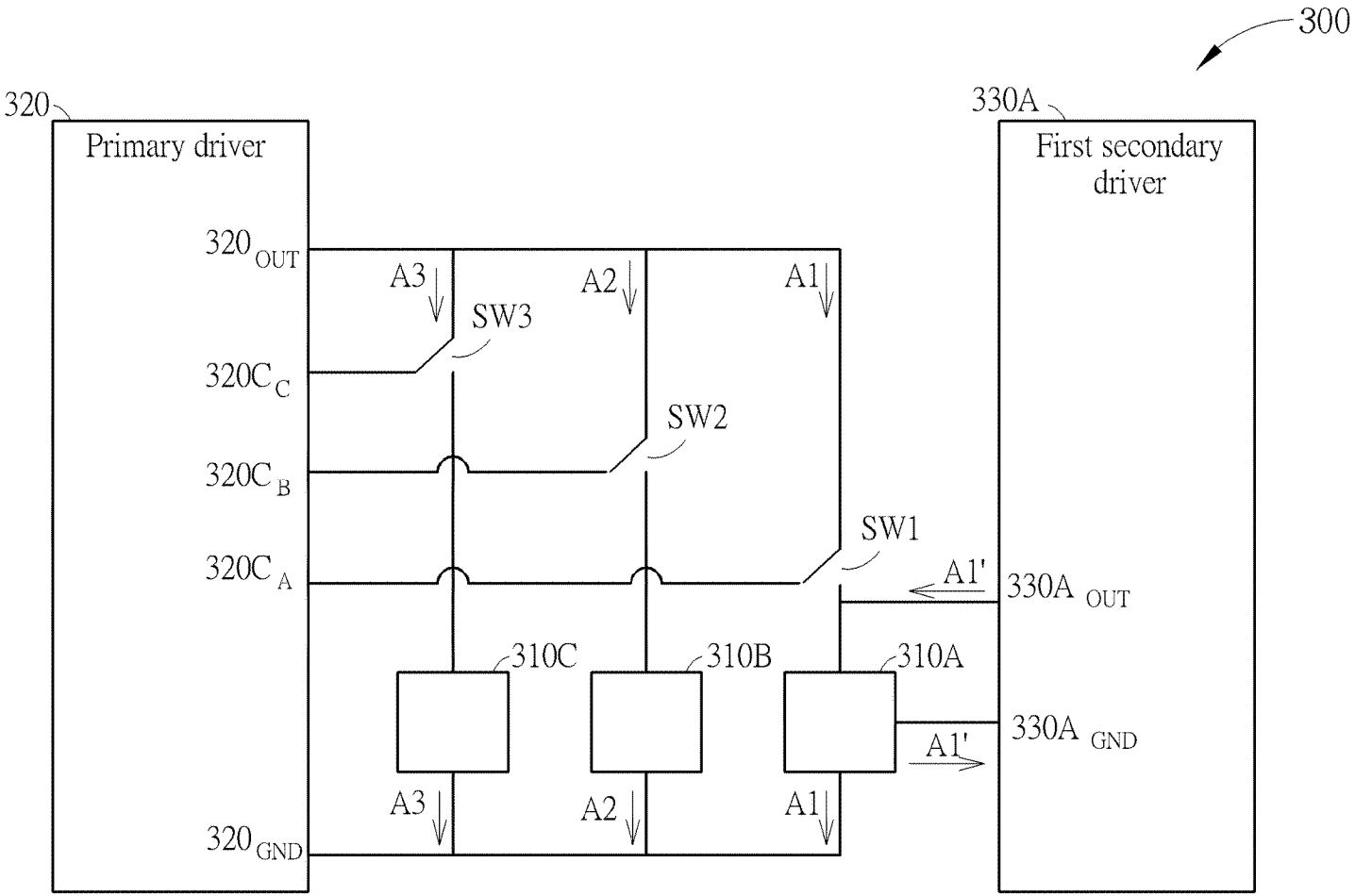
FIG. 4 shows an electronic device according to another embodiment of the present invention.

In some embodiments of the present invention, the electronic device may be used in a projector as a light source in the projector. In this case, the electronic device may further include more light modules to display images with even more colors. FIG. 4 shows an electronic device 300 according one embodiment of the present invention. The electronic device 300 includes a first light module 310A, a second light module 310B, a third light module 310C, a primary driver 320, and a first secondary driver 330A.

The primary driver 320 has an output terminal $\mathbf{320}_{OUT}$ for outputting currents A1, A2, and A3 to the first light module 310A, the second light module 310B, and the third light module 310C respectively. Also, the primary driver 320 has a first control terminal $\mathbf{320}C_A$ for controlling a switch SW1 coupled between the first light module 310A and the primary driver 320. For example, when the primary driver 320 turns on the switch SW1, the current A1 can be induced and flows through the first light module 310A to a ground terminal $\mathbf{320}_{GND}$ of the primary driver 320 for turning on the first light module 310A.

Similarly, the primary driver 320 has a second control terminal $\mathbf{320}C_B$ for controlling a switch SW2 coupled between the second light module 310B and the primary driver 320 to turn on the second light module 310B, and a third control terminal $\mathbf{320}C_C$ for controlling a switch SW3 coupled between the third light module 310C and the primary driver 320 to turn on the third light module 310C.

The first secondary driver 330A has an output terminal $\mathbf{330}A_{OUT}$ and a ground terminal $\mathbf{330}A_{GND}$ both coupled to the first light module 310A.

When turned on, the first light module 310A, the second light module 310B, and the third light module 310C are able to emit a first light, a second light, and a third light respectively. Since the first light module 310A, the second light module 310B, and the third light module 310C emit lights of different colors, the electronic device 300 is able to display images with more combinations of colors than the electronic device 200.

Figure 5:
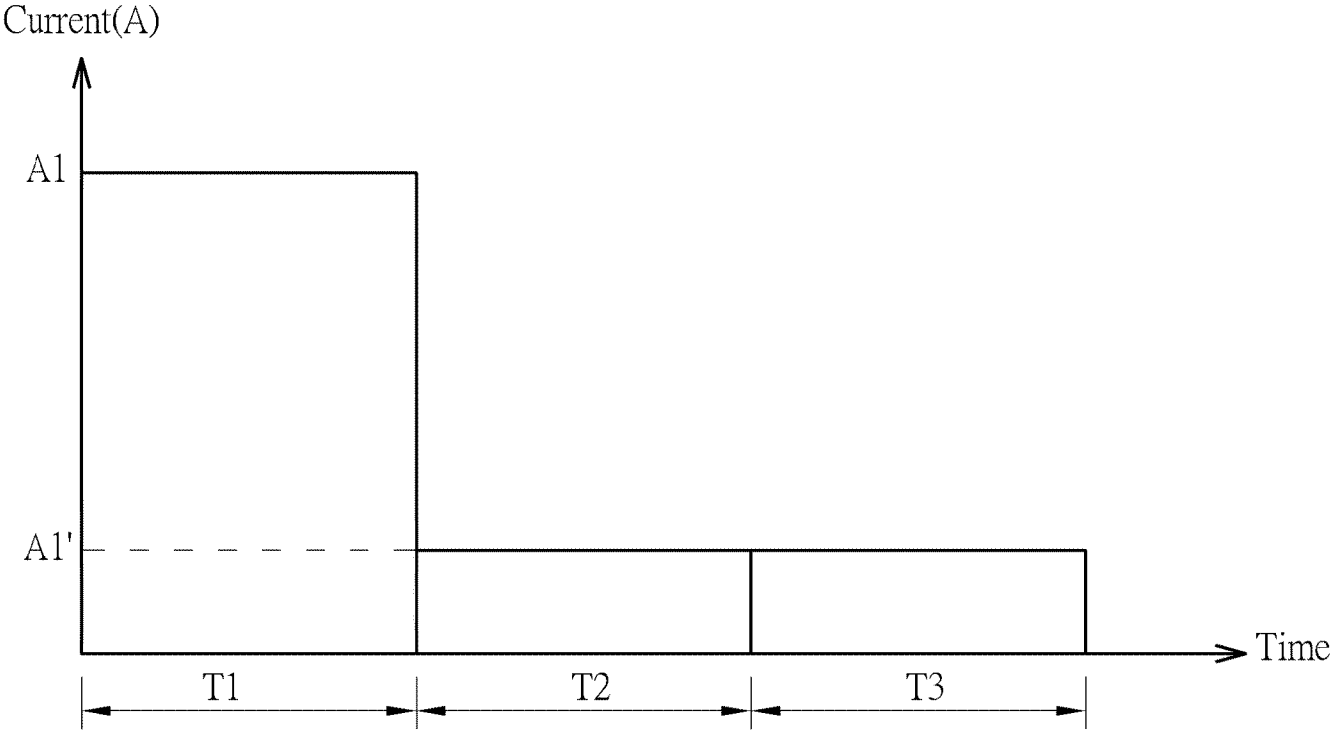
FIG. 5 shows a timing diagram of currents in the electronic device of FIG. 3.

FIG. 5 shows a timing diagram of the currents A1 and A1' inputted to the first light module 310A by the primary driver 320 and the first secondary driver 330A respectively. In FIG. 5, the primary driver 320 turns on the first light module 310A during the first duration T1, turns on the second light module 310B during the second duration T2, and turns on the third light module 310C during the third duration T3. Since the primary driver 320 can only turns on one light module at a time, the primary driver 320 does not turn on the first light module 310A during the second duration T2 and the third duration T3.

To increase the light density, the first secondary driver 330A can turn on the first light module 310A to increase the light density when the primary driver 320 turns on the second light module 310B and even when the primary driver 320 turns on the third light module 310C. Namely, the first light module 310A can be turned on by the primary driver 320 during the first duration T1, and can be turned on by the first secondary driver 330A during the second duration T2 and the third duration T3 so as to increase the light density of the electronic device 300. In some embodiments, the first secondary driver 330A may only turn on the first light module 310A during the second duration T2 or only turn on the first light module 310A during the third duration T3 according to the system requirement.

Since green light is less sensitive to human eyes than red light and blue light, the first secondary driver 310A can be used to turn on the first light module 310A for emitting green light. That is, the first light can be green light, the second light can be blue light, and the third light can be red light. In this case, while the light density of the electronic device 300 is increased, the impact to the color can be minimized. According to some embodiments, if the current A1 during the first duration T1 is 16 A, and the current A1' during the second duration T2 and the third duration T3 is 3.5 A, then the overall light density of the electronic device 300 can be increased by 10%.

Furthermore, when the primary driver 320 inputs current A1 to the first light module 310A for turning on the first light module 310A during the first duration T1, the current A1 may flow to the first secondary driver 330A through the output terminal 330$A_{OUT}$ of the first secondary driver 330A and may damage the first secondary driver 330A if the first secondary driver 330A does not have any protection structure at the output terminal 330$A_{OUT}$. Similarly, When the first secondary driver 330A inputs current A1' to the first light module 310A for turning on the first light module 310 during the second duration T2 and/or the third duration T3, the current A1' may flow to the primary driver 320 through the output terminal 320$_{OUT}$ or the ground terminal 320$_{GND}$ of the primary driver 320 and may damage the primary driver 320 if the primary driver 320 does not include any proper protection structure. Thus, proper protection structures may be applied.

Figure 6:
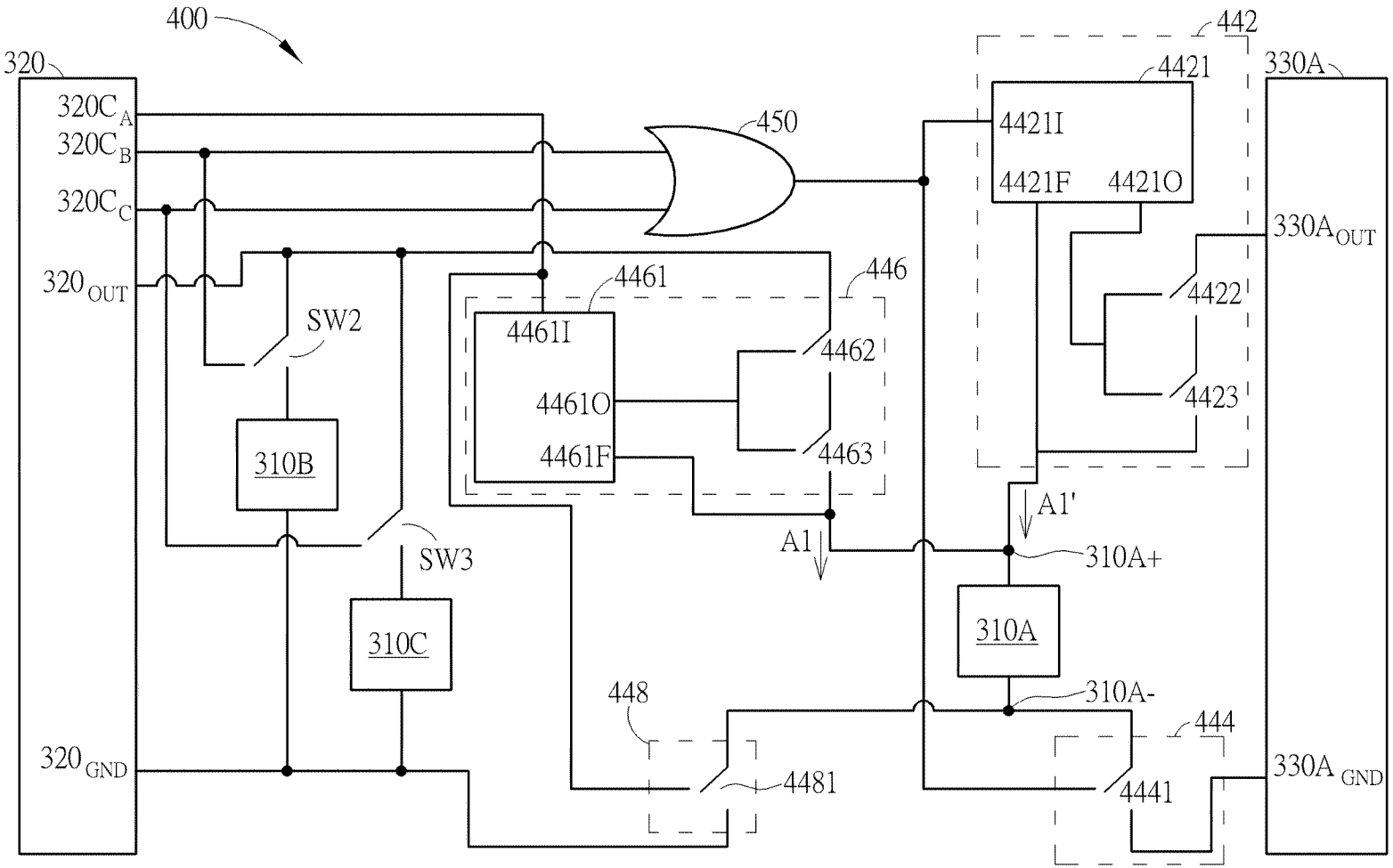
FIG. 6 shows an electronic device according to another embodiment of the present invention.

FIG. 6 shows an electronic device 400 according one embodiment of the present invention. The electronic device 400 includes the first light module 310A, the second light module 310B, the third light module 310C, the primary driver 320, the first secondary driver 330A, a first control circuit 442, a second control circuit 444, a third control circuit 446 and a fourth control circuit 448.

The first control circuit 442 is coupled to an anode 310A+ of the first light module 310A, the output terminal 330$A_{OUT}$ of the first secondary driver 330A, the second control terminal 320$C_B$ of the primary driver 320 and the third control terminal 320$C_C$ of the primary driver 320 for controlling an electrical connection between the anode 310A+ of the first light module 310A and the output terminal 330$A_{OUT}$ of the first secondary driver 330A according to voltages of the second control terminal 320$C_B$ and the third control terminal 320$C_C$.

The second control circuit 444 is coupled to a cathode 310A− of the first light module 310A, a ground terminal 330$A_{GND}$ of the first secondary driver 330A, the second control terminal 320$C_B$, and the third control terminal 320$C_C$ for controlling an electrical connection between the cathode 310A− of the first light module 310A and the ground terminal 330$A_{GND}$ of the first secondary driver 330A according to the voltages of the second control terminal 320$C_B$ and the third control terminal 320$C_C$.

The third control circuit 446 is coupled to the anode 310A+ of the first light module 310A, the first control terminal 320$C_A$, and the output terminal 320$_{OUT}$ of the primary driver 320. The third control circuit 446 is for controlling an electrical connection between the anode 310A+ of the first light module 310A and the output terminal 320$_{OUT}$ of the primary driver 320 according to a voltage of the first control terminal 320$C_A$.

The fourth control circuit 448 is coupled to the cathode 310A− of the first light module 310A, the ground terminal 320$_{GND}$ of the primary driver 320, and the first control terminal 320$C_A$. The fourth control circuit 448 is configured to control an electrical connection between the cathode 310A− of the first light module 310 and the ground terminal 320$_{GND}$ of the primary driver 320 according to the voltage of the first control terminal 320$C_A$.

In some embodiments, the first control circuit 442 electrically connects the anode 310A+ of the first light module 310A and the output terminal 330$A_{OUT}$ of the first secondary driver 330A during the second duration T2 and/or the third duration T3. Also, the second control circuit 444 electrically connects the cathode 310A− of the first light module 310A and the ground terminal 330$A_{GND}$ of the first secondary driver 330A during the second duration T2 and/or the third duration T3. Therefore, the first secondary driver 330A is able to turn on the first light module by inputting the current A1' to the first light module 310A during the second duration T2 and/or the third duration T3.

In addition, the first control circuit 442 electrically disconnects the anode 310A+ of the first light module 310A and the output terminal 330$A_{OUT}$ of the first secondary driver 330A during the first duration T1, and the second control circuit 444 electrically disconnects the cathode 310A− of the first light module 310A and the ground terminal 330$A_{GND}$ of the first secondary driver 330A during the first duration T1. Consequently, during the first duration T1 when the primary driver 320 inputs the current A1 to the first light module 310A, the first control circuit 442 and the second control circuit 444 can electrically disconnect the first secondary driver 330A from the first light module 310A and protect the first secondary driver 330A from being damaged by the current A1.

When the primary driver 320 turns on the first light module 310A, the first control terminal 320$C_A$ is at a high voltage level so the third control circuit 446 and the fourth control circuit 448 can electrically connect the primary driver 320 and the first light module 310A accordingly. Therefore, the current A1 can flow to the first light module 330A and return to the ground terminal 320$_{GND}$ of the primary driver 320. Contrarily, when the primary driver 320 does not turn on the first light module 310A, the first control terminal 320$C_A$ is at a low voltage level so the third control circuit 446 and the fourth control circuit 448 can electrically disconnect the primary driver 320 from the first light module 310A. The similar principles can also apply to the second control terminal 320$C_B$ and the third control terminal 320$C_C$ when controlling the switches SW2 and SW3. Therefore, by assuming the high voltage level as logic 1 and the low voltage level as logic 0, the electronic device 400 may use an OR gate 450 to indicate the timings to control the electrical connections for the first control circuit 442 and the second control circuit 444.

In FIG. 6, the OR gate 450 has a first input terminal coupled to the second control terminal 320$C_B$, a second input terminal coupled to the third control terminal 320$C_C$, and an output terminal coupled to the first control circuit 442 and the second control circuit 444. That is, the first control circuit 442 and the second control circuit 444 are coupled to the second control terminal 320$C_B$ and the third control terminal 320$C_C$ through the OR gate 450.

Table 1 shows a truth table of the second control terminal 320$C_B$ and the third terminal 320$C_C$ of the primary driver 320, and the output terminal of the OR gate 450.

TABLE 1

| | First duration T1 | Second duration T2 | Third duration T3 |
|---|---|---|---|
| second control terminal $320C_B$ | 0 | 1 | 0 |
| third control terminal $320C_C$ | 0 | 0 | 1 |
| output terminal of OR gate 450 | 0 | 1 | 1 |

During the first duration T1, since the primary driver 320 does not turn on the second light module 310B and the third light module 310C, the second control terminal $320C_B$ and the third terminal $320C_C$ are at the low voltage level, representing logic 0. Accordingly, the output terminal of the OR gate 450 is also at the low voltage level, representing logic 0, and the first control circuit 442 and the second control circuit 444 electrically disconnect the first secondary driver 330A from the first light module 310A. Consequently, the current A1 is not able to flow into the first secondary driver 330A.

During the second duration T2, since the primary driver 320 turns on the second light module 310B instead of the first light module 310A and the third light module 310C, the second control terminal $320C_B$ is at the high voltage level, representing logic 1, and the third terminal $320C_C$ is at the low voltage level, representing logic 0. Accordingly, the output terminal of the OR gate 450 is at the high voltage level, representing logic 1, so the first control circuit 442 and the second control circuit 444 electrically connect the first secondary driver 330A and the first light module 310A. Therefore, the first secondary driver 330A is able to input current A1' to the first light module 310A during the second duration T2.

Similarly, during the third duration T3, the second control terminal $320C_B$ is at the low voltage level, representing logic 0, and the third terminal $320C_C$ is at the high voltage level, representing logic 1. Accordingly, the output terminal of the OR gate 450 is at the high voltage level, representing logic 1, and the first control circuit 442 and the second control circuit 444 electrically connect the first secondary driver 330A and the first light module 310A. Thus, the first secondary driver 330A is able to input current A1' to the first light module 310A during the third duration T3.

In FIG. 6, the first control circuit 442 includes a first gate driving circuit 4421, a first switch 4422, and a second switch 4423 to control the electrical connection.

The first gate driving circuit 4421 has an input terminal 44211, a driving output terminal 44210, and a floating supply return terminal 4421F. The input terminal 44211 of the first gate driving circuit 4421 is coupled to the output terminal of the OR gate 450. The first gate driving circuit 4421 is able to drive the voltage received by the input terminal 44211 to a proper high voltage according a voltage level of the floating supply return terminal 4421F and output the proper high voltage through the driving output terminal 44210 to turn on the switches 4422 and 4423 effectively.

The first switch 4422 has a first terminal, a second terminal, and a control terminal. The first terminal of the first switch 4422 is coupled to the output terminal $330A_{OUT}$ of the first secondary driver 330A, and the control terminal of the first switch 4422 is coupled to the driving output terminal 44210 of the first gate driving circuit 4421.

The second switch 4423 has a first terminal, a second terminal, and a control terminal. The first terminal of the second switch 4423 is coupled to the second terminal of the first switch 4422, the second terminal of the second switch 4423 is coupled to the floating supply return terminal 4421F of the first gate driving circuit 4421 and the anode 310A+ of the first light module 310A, and the control terminal of the second switch 4423 is coupled to the driving output terminal 44210 of the first gate driving circuit 4421.

Since the voltage of the driving output terminal 44210 can be dynamically adjusted according to the voltage of the floating supply return terminal 4421F, the first switch 4422 and the second switch 423 can be turned on effectively to electrically connect the anode 310A+ of the first light module 310A and the output terminal $330A_{OUT}$ of the first secondary driver 330A even when the anode 310A+ is driven to a high voltage.

Since the second control circuit 444 is not coupled to the anode 310A+ of the first light module 310A but the cathode 310A− of the first light module 310A, the second control circuit 444 may use one switch for controlling the electrical connection.

In FIG. 6, the second control circuit 444 includes a third switch 4441 having a first terminal, a second terminal, and a control terminal. The first terminal of the third switch 4441 is coupled to the cathode 310A− of the first light module 310A, the second terminal of the third switch 4441 is coupled to the ground terminal $330A_{GND}$ of the first secondary driver 330A, and the control terminal of the third switch 4441 is coupled to the output terminal of the OR gate 450. Therefore, when the output terminal of the OR gate 450 is at the high voltage level, the third switch 4441 is turned on and is able to electrically connect the cathode 310A− of the first light module 310A and the ground terminal $330A_{GND}$ of the first secondary driver 330A.

In addition, to allow the primary driver 320 to turn on the first light module 310A during the first duration T1, the third control circuit 446 electrically connects the anode 310A+ of the first light module 310A and the output terminal $320_{OUT}$ of the primary driver 320 during the first duration T1, and the fourth control circuit 448 electrically connects the cathode 310A− of the first light module 310A and the ground terminal $320_{GND}$ of the primary driver 320 during the first duration T1. Therefore, the primary driver 320 is able to input the current A1 through the path electrically connected by the third control circuit 446 and the fourth control circuit 448.

Furthermore, the third control circuit 446 electrically disconnects the anode 310A+ of the first light module 310A and the output terminal $320_{OUT}$ of the primary driver 320 during the second duration T2 and/or the third duration T3 and the fourth control circuit 448 electrical disconnects the cathode 310A− of the first light module 310A and the ground terminal $320_{GND}$ of the primary driver 320 during the second duration T2 and/or the third duration T3. Consequently, during the second duration T2 and/or the third duration T3 when the first secondary driver 330A inputs the current A1' to the first light module 310A, the third control circuit 446 and the fourth control circuit 448 can electrically disconnect the primary driver 320 from the first light module 310A, and protect the primary driver 320A from being damaged by the current A1'.

Since the first control terminal $320C_A$ is at a high voltage level during the first duration T1 when the primary driver 320 turns on the first light module 330A, and the first control terminal $320C_A$ is at a low voltage level during the second duration T2 and/or the third duration T3 when the primary driver 320 does not turn on the first light module 330A, the voltage of the first control terminal $320C_A$ can be used to indicate the timings to control the electrical connections for the third control circuit 446 and the fourth control circuit 448 by assuming the high voltage level as logic 1 and the low voltage level as logic 0.

In FIG. 6, the third control circuit 446 includes a second gate driving circuit 4461, a fourth switch 4462, and a fifth switch 4463.

The second gate driving circuit 4461 has an input terminal 44611, a driving output terminal 44610 and a floating supply return terminal 4461F. The input terminal 44611 of the second gate driving circuit 4461 is coupled to the first control terminal $320C_A$.

The fourth switch 4462 has a first terminal, a second terminal, and a control terminal. The first terminal of the fourth switch 4462 is coupled to the output terminal $320_{OUT}$ of the primary driver 320, and the control terminal of the fourth switch 4462 is coupled to the driving output terminal 44610 of the second gate driving circuit 4461.

The fifth switch 4463 has a first terminal, a second terminal, and a control terminal. The first terminal of the fifth switch 4463 is coupled to the second terminal of the fourth switch 4462, the second terminal of the fifth switch 4463 is coupled to the floating supply return terminal 4461F of the second gate driving circuit 4461 and the anode 310A+ of the first light module 310A, and the control terminal of the fifth switch 4463 is coupled to the driving output terminal 44610 of the second gate driving circuit 4461.

Since the voltage of the driving output terminal 44610 can be dynamically adjusted according to the voltage of the floating supply return terminal 4461F, the fourth switch 4462 and the fifth switch 4463 can be turned on effectively to electrically connect the anode 310A+ of the first light module 310A and the output terminal $320_{OUT}$ of the primary driver 320 even when the voltage of the anode 310A+ is driven to a high voltage.

The fourth control circuit 448 includes a sixth switch 4481 having a first terminal, a second terminal and a control terminal. The first terminal of the sixth switch 4481 is coupled to the cathode 310A− of the first light module 310A, the second terminal of the sixth switch 4481 is coupled to the ground terminal $320_{GND}$ of the primary driver 320, and the control terminal of the sixth switch 4481 is coupled to the first control terminal $320C_A$.

In some embodiments of the present invention, with the gate driving circuits 4461 and 4421, the switches 4422, 4423, 4441, 4462, 4463, and 4481 can be implemented by transistors such as N type metal-oxide-semiconductor field-effect transistors.

With the electronic device 400, the first secondary driver 330A is able to turn on the first light module 310A when the primary driver 320 turns on the other light modules 310B and 310C. Therefore the light density of the electronic device 400 can be higher than the prior art while no complicated circuits are needed.

In some embodiments, the electronic device 400 may further include more light modules or more secondary drivers to turn on different light modules during different durations according to the system needs.

Figure 7:
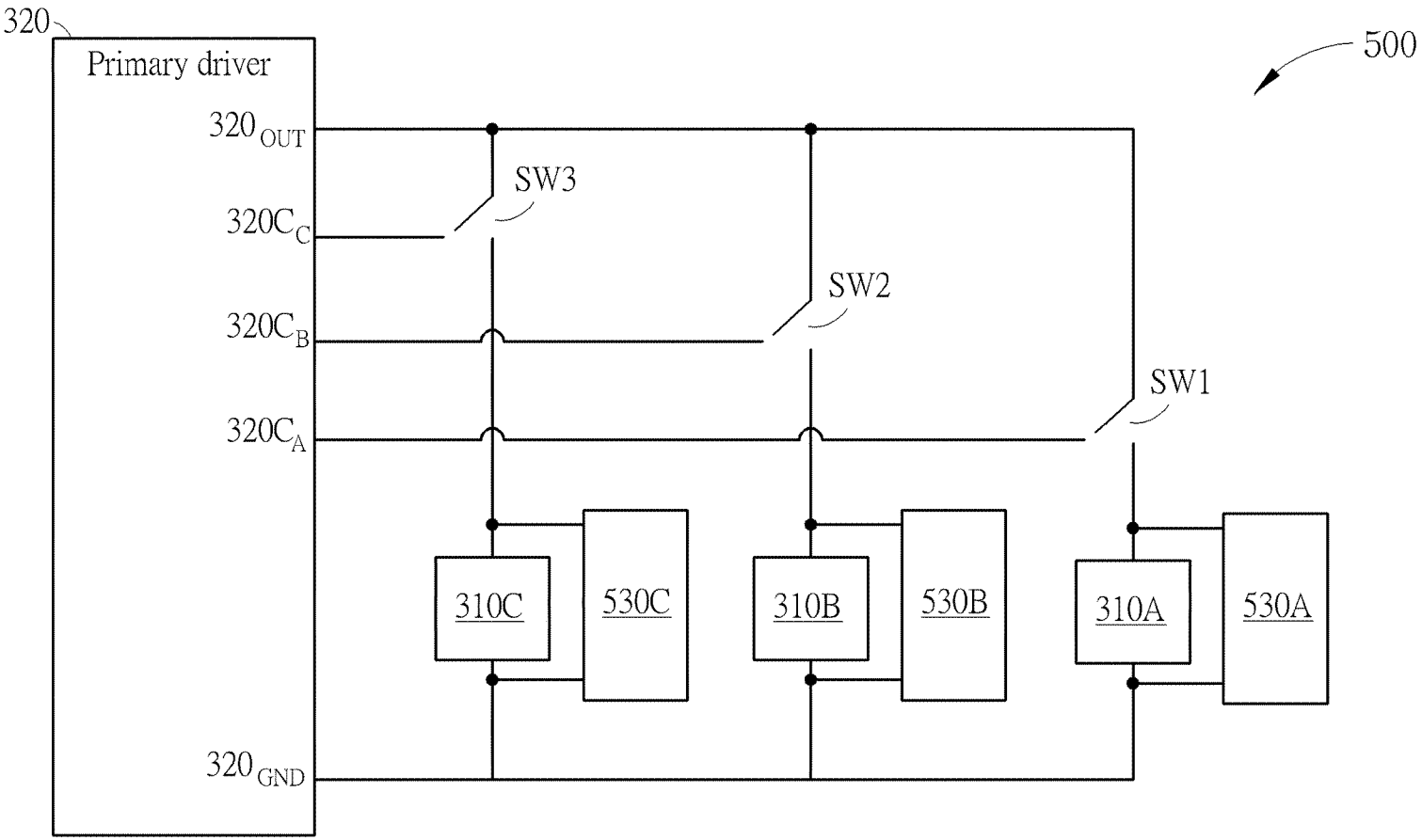
FIG. 7 shows an electronic device according to another embodiment of the present invention.

FIG. 7 shows an electronic device 500 according to one embodiment of the present invention. The difference between the electronic device 500 and the electronic device 300 is that the electronic device 500 further includes a second secondary driver 530B and a third secondary driver 530C. The second secondary driver 530B can be used for turning on the second light module 310B during the first duration T1 and/or the third duration T3, and the third secondary driver 530C can be used for turning on the third light module 310C during the first duration T1 and/or the second duration T2.

In this case, the first light module 310A, the second light module 310B, and the third light module 310C of the electronic device 500 are able to emit lights during all durations with different light densities so the overall light density of the electronic device 500 can further be increased.

Figure 8:
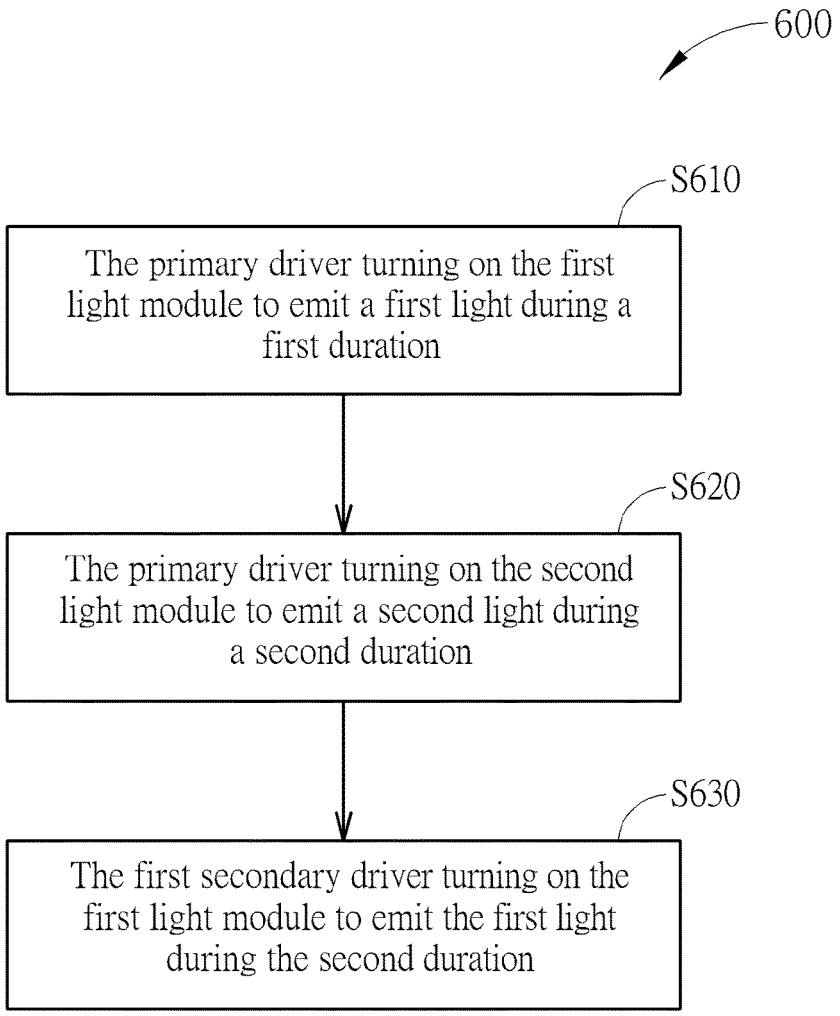
FIG. 8 shows a flow chart of a method for operating an electronic device according to one embodiment of the present invention.

FIG. 8 shows a flow chart of a method 600 for operating the electronic device 200. The method 600 includes steps S610 to S630 but not limited to the order below.

S610: the primary driver 220 turning on the first light module 210A to emit a first light during a first duration T1;

S620: the primary driver 220 turning on the second light module 210B to emit a second light during a second duration T2; and S630: the first secondary driver 230A turning on the first light module 210A to emit the first light during the second duration T2.

Since the first secondary driver 230A turns on the first light module 210A during the second duration T2, the light density of the electronic device 200 can be increased according to the method 500. Also, during the second duration T2, the primary driver 220 may not turn on the first light module 210A, and during the first duration T1, the first secondary driver 230A may not turn on the first light module 210A.

In addition, to avoid the first light emitted in the second duration T2 from influencing the final color seen by viewers, a first light density of the first light emitted during the first duration T1 is higher than a second light density of the first light emitted during the second duration T2.

Figure 9:
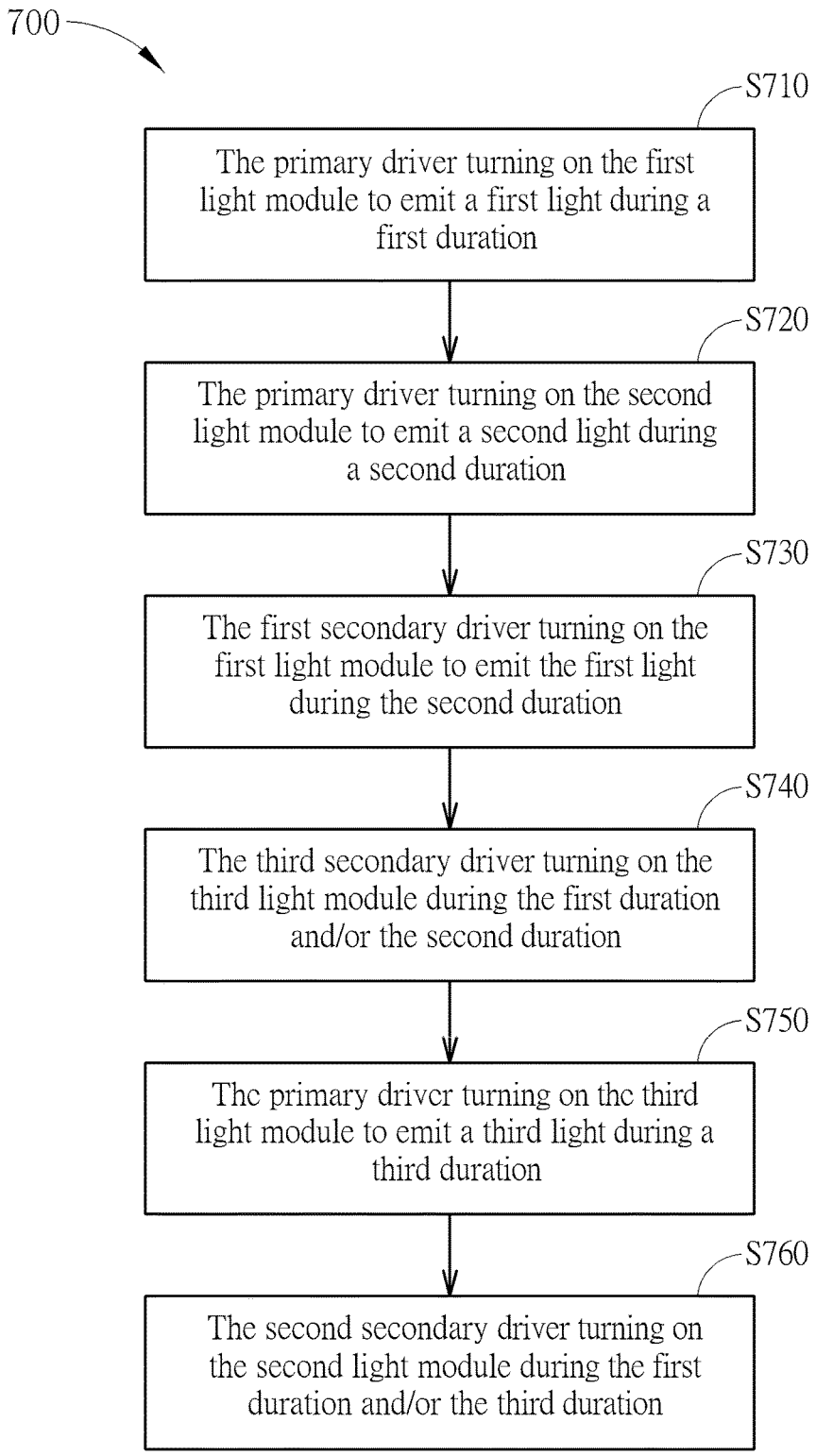
FIG. 9 shows a flow chart of a method for operating an electronic device according to another embodiment of the present invention.

FIG. 9 shows a flow chart of a method 700 for operating the electronic device 500. The method 700 includes steps S710 to S780 but not limited to the order below.

S710: the primary driver 320 turning on the first light module 310A to emit a first light during a first duration T1;

S720: the primary driver 320 turning on the second light module 310B to emit a second light during a second duration T2;

S730: the first secondary driver 330A turning on the first light module 310A to emit the first light during the second duration T2;

S740: the third secondary driver 530C turning on the third light module 310C during the first duration T1 and/or the second duration T2;

S750: the primary driver 320 turning on the third light module 310C to emit a third light during a third duration T3; and S760: the second secondary driver 530B turning on the second light module 310B during the first duration T1 and/or the third duration T3.

Also, during the second duration T2, the primary driver 320 may not turn on the first light module 310A, and during the first duration T1, the first secondary driver 330A may not turn on the first light module 310A.

Since the first secondary driver 330A can turn on the first light module 310A during the second duration T2 and/or the third duration T3, the second secondary driver 530B can turn on the second light module 310B during the first duration T1 and/or the third duration T3, and the third secondary driver 530C can turn on the third light module 310C during the first duration T1 and/or the second duration T2, the light density of the electronic device 500 can be further increased according to the method 700.

In summary, the electronic devices and the methods for operating the electronic devices provided by the embodiments of the present invention can use secondary driver to turn on a light module while the primary driver turns on other light modules. Therefore, the light density can be increased Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electronic device, comprising:

a first light module configured to emit a first light;

a second light module configured to emit a second light;

a primary driver having a first control terminal configured to turn on the first light module during a first duration, and a second control terminal configured to turn on the second light module during a second duration; and a first secondary driver configured to turn on the first light module during the second duration.

2. The electronic device of claim 1, wherein the primary driver is further configured not to turn on the first light module during the second duration, and the first secondary driver is further configured not turn on the first light module during the first duration.

3. The electronic device of claim 1, wherein:

when the primary driver turns on the first light module, the first light has a first light density;

when the first secondary driver turns on the first light module, the first light has a second light density; and the first light density is higher than the second light density.

4. The electronic device of claim 1, further comprising:

a third light module configured to emit a third light;

wherein the primary driver further has a third control terminal configured to turn on the third light module during a third duration.

5. The electronic device of claim 4, wherein the first secondary driver is further configured to selectively turn on the first light module when the primary driver turns on the third light module.

6. The electronic device of claim 4, further comprising:

a first control circuit coupled to an anode of the first light module, an output terminal of the first secondary driver, the second control terminal, and the third control terminal, and configured to control an electrical connection between the anode of the first light module and the output terminal of the first secondary driver according to voltages of the second control terminal and the third control terminal; and a second control circuit coupled to a cathode of the first light module, a ground terminal of the first secondary driver, the second control terminal, and the third control terminal, and configured to control an electrical connection between the cathode of the first light module and the ground terminal of the first secondary driver according to the voltages of the second control terminal and the third control terminal.

7. The electronic device of claim 6, wherein:

the first control circuit electrically connects the anode of the first light module and the output terminal of the first secondary driver during the second duration and/or the third duration, and electrically disconnects the anode of the first light module and the output terminal of the first secondary driver during the first duration; and the second control circuit electrically connects the cathode of the first light module and the ground terminal of the first secondary driver during the second duration and/or the third duration, and electrically disconnects the cathode of the first light module and the ground terminal of the first secondary driver during the first duration.

8. The electronic device of claim 6, further comprising an OR gate having a first input terminal coupled to the second control terminal, a second input terminal coupled to the third control terminal, and an output terminal coupled to the first control circuit and the second control circuit.

9. The electronic device of claim 8, wherein the first control circuit comprises:

a first gate driving circuit having an input terminal coupled to the output terminal of the OR gate, a driving output terminal, and a floating supply return terminal;

a first switch having a first terminal coupled to the output terminal of the first secondary driver, a second terminal, and a control terminal coupled to the driving output terminal of the first gate driving circuit; and a second switch having a first terminal coupled to the second terminal of the first switch, a second terminal coupled to the floating supply return terminal of the first gate driving circuit and the anode of the first light module, and a control terminal coupled to the driving output terminal of the first gate driving circuit.

10. The electronic device of claim 8, wherein the second control circuit comprises:

a third switch having a first terminal coupled to the cathode of the first light module, a second terminal coupled to the ground terminal of the first secondary driver, and a control terminal coupled to the output terminal of the OR gate.

11. The electronic device of claim 6, further comprising:

a third control circuit coupled to the anode of the first light module, the first control terminal, and an output terminal of the primary driver, and configured to control an electrical connection between the anode of the first light module and the output terminal of the primary driver according to a voltage of the first control terminal; and a fourth control circuit coupled to the cathode of the first light module, a ground terminal of the primary driver, and the first control terminal, and configured to control an electrical connection between the cathode of the first light module and the ground terminal of the primary driver according to the voltage of the first control terminal.

12. The electronic device of claim 11, wherein:

the third control circuit electrically connects the anode of the first light module and the output terminal of the primary driver during the first duration, and electrically disconnects the anode of the first light module and the output terminal of the primary driver during the second duration and/or the third duration; and the fourth control circuit electrically connects the cathode of the first light module and the ground terminal of the primary driver during the first duration, and electrical disconnects the cathode of the first light module and the ground terminal of the primary driver during the second duration and/or the third duration.

13. The electronic device of claim 11, wherein the third control circuit comprises:

a second gate driving circuit having an input terminal coupled to the first control terminal, a driving output terminal, and a floating supply return terminal;

a fourth switch having a first terminal coupled to the output terminal of the primary driver, a second terminal, and a control terminal coupled to the driving output terminal of the second gate driving circuit; and a fifth switch having a first terminal coupled to the second terminal of the fourth switch, a second terminal coupled to the floating supply return terminal of the second gate driving circuit and the anode of the first light module, and a control terminal coupled to the driving output terminal of the second gate driving circuit.

14. The electronic device of claim 11, wherein the fourth control circuit comprises:

a sixth switch having a first terminal coupled to the cathode of the first light module, a second terminal coupled to the ground terminal of the primary driver, and a control terminal coupled to the first control terminal.

15. The electronic device of claim 4, further comprising:

a second secondary driver configured to turn on the second light module during the first duration and/or the third duration; and a third secondary driver configured to turn on the third light module during the first duration and/or the second duration.

16. The electronic device of claim 1, wherein the first color light is green light.

17. A method for operating an electronic device, the electronic device comprising a first light module, a second light module, a primary driver, and a first secondary driver, the method comprising:

the primary driver turning on the first light module to emit a first light during a first duration;

the primary driver turning on the second light module to emit a second light during a second duration; and the first secondary driver turning on the first light module to emit the first light during the second duration.

18. The method of claim 17, wherein:

when the primary driver turns on the first light module to emit the first light, the first light has a first light density;

when the first secondary driver turns on the first light module to emit the first light, the first light has a second light density; and the first light density is higher than the second light density.

19. The method of claim 17, further comprising:

the primary driver not turning on the first light module during the second duration; and the first secondary driver not turning on the first light module during the first duration.

20. The method of claim 17, wherein the electronic device further comprises a third light module, a second secondary driver and a third secondary driver, and the method further comprises:

the primary driver turning on the third light module to emit a third light during a third duration;

the second secondary driver turning on the second light module during the first duration and/or the third duration; and the third secondary driver turning on the third light module during the first duration and/or the second duration.

* * * * *